US006142914A

United States Patent [19]

Crawford et al.

[11] Patent Number: 6,142,914

[45] Date of Patent: Nov. 7, 2000

[54] EXERCISING ATTACHMENTS FOR WHEELCHAIRS

[76] Inventors: Vincent R. Crawford, 9899 Wilson Mills Rd., Chardon, Ohio 44024; Robert E. Gunya, R.R.# 2 Box 165, Clarion, Pa. 16214

[21] Appl. No.: 09/184,502

[22] Filed: Nov. 2, 1998

[51] Int. Cl.[7] ..... A63B 23/035

[52] U.S. Cl. ..... 482/51; 482/57; 482/73; 482/79; 482/112; 482/146; 482/904; 280/304.1; 601/36

[58] Field of Search ..... 482/79, 80, 142, 482/146, 904, 112, 73, 57, 51; 601/31, 35, 36; 280/304.1

[56] References Cited

U.S. PATENT DOCUMENTS

| | | | |
|---|---|---|---|
| 2,629,371 | 2/1953 | Kocian et al. | 601/24 |
| 2,855,979 | 10/1958 | Hubbard | 280/304.1 |
| 3,083,967 | 4/1963 | Steel | 280/304.1 |
| 3,754,547 | 8/1973 | Walker | 601/24 |
| 4,159,111 | 6/1979 | Lowth . | |
| 4,222,376 | 9/1980 | Praprotnik . | |
| 4,421,336 | 12/1983 | Petrofsky et al. | 280/525 |
| 4,501,421 | 2/1985 | Kane et al. . | |
| 4,572,501 | 2/1986 | Durham et al. | 482/60 |
| 4,824,132 | 4/1989 | Moore | 280/304.1 |
| 4,883,268 | 11/1989 | Salkind . | |
| 5,005,829 | 4/1991 | Caruso | 482/112 |
| 5,033,736 | 7/1991 | Hirshfeld | 601/36 |
| 5,048,827 | 9/1991 | Caruso . | |
| 5,083,807 | 1/1992 | Bobb et al. | 280/304.1 |
| 5,242,179 | 9/1993 | Beddome et al. | 280/233 |
| 5,284,131 | 2/1994 | Gray . | |
| 5,324,060 | 6/1994 | Van Vooren et al. | 280/304.1 |
| 5,343,856 | 9/1994 | Proctor | 601/35 |
| 5,839,995 | 11/1998 | Chen | 482/92 |
| 5,951,442 | 9/1999 | Adams et al. | 482/57 |

FOREIGN PATENT DOCUMENTS

| | | | |
|---|---|---|---|
| 80718 | 3/1956 | Denmark | 280/304.1 |
| 296205 | 11/1991 | German Dem. Rep. | 601/31 |
| 2439402 | 3/1976 | Germany | 601/31 |
| 4114264 | 11/1992 | Germany | 482/68 |

*Primary Examiner*—John Mulcahy
*Assistant Examiner*—Victor K. Hwang
*Attorney, Agent, or Firm*—Vickers, Daniels & Young

[57] ABSTRACT

An exercise device is provided for removable attachment to the foot rests of a wheelchair to enable a person sitting in the seat of the wheelchair to exercise at least one of his or her arms and legs. The device includes a base slidably received on the foot rests and an exercising arrangement adjustably mounted on the base to accommodate the physical stature of a person sitting in the wheelchair.

49 Claims, 7 Drawing Sheets

EXERCISING ATTACHMENTS FOR WHEELCHAIRS

BACKGROUND OF THE INVENTION

This invention relates to the art of exercising and, more particularly, to exercising devices removably mountable on the foot rests of a wheelchair to enable the exercising of the arms and/or legs of a person sitting in the wheelchair.

Manually operated and motorized exercising devices have been provided heretofore for facilitating helpful exercise and therapeutic treatment for promoting the health and rehabilitation of persons having different degrees of disabilities due to, for example, injury, strokes, arthritis, chronic pain, knee or hip replacement surgery and the like. In these and other situations, there is a need to exercise a person's unused or under used muscles or limbs to avoid stiffened joints and tendons, and atrophy of the person's muscles. Many persons suffering from the foregoing and other disabilities are either temporarily or permanently confined to a wheelchair, whereby access to standard exercising devices, even in a rehabilitation center, is difficult and sometimes impossible. While exercising devices have been provided heretofore for use by a person seated in a wheelchair, such as shown for example in U.S. Pat. No. 4,883,268 to Salkind, U.S. Pat. No. 5,048,827 to Caruso and U.S. Pat. No. 5,284,131 to Gray, the devices are floor supported. Accordingly, it is necessary to move one or the other of the exercising device and wheelchair to a given location and then into the use position with respect to the exercising device, and the wheelchair and exercising device must remain in that position and location during the exercising session. Moreover, the exercising devices are quite large, structurally, and cumbersome to handle and, for the most part, require a considerable amount of space for storage. Because the exercising device is floor supported, a certain amount of time is required to maneuver the chair and exercising device into the use position and, additionally, the size and/or structure of the exercising device must be such as to provide stability thereof against displacement relative to the wheelchair in response to the exerciser's operation of the device.

SUMMARY OF THE INVENTION

In accordance with the present invention, exercising devices are provided for use by a person sitting in a wheelchair and which devices are in the form of attachments removably mounted on the foot rests of a wheelchair. Accordingly, the exercising device can be quickly mounted on a wheelchair for use by a person sitting therein and, advantageously, the exercising device is movable with the wheelchair. Accordingly, if a wheelchair and exercising device need to be transported to a patient's room in a rehabilitation center, for example, the exercising device can be mounted on the wheelchair and transported therewith as opposed to having to transport the exercising device and wheelchair as separate items. Moreover, when the exercising device is mounted on the wheelchair, the person seated in the chair can readily move or be moved from one location to another so as, for example, to change the environment in which the exercising is taking place. Further in accordance with the invention, the exercising devices are structurally compact and lightweight which promotes the economy of manufacture, the ease of handling with respect to the mounting and dismounting thereof relative to the foot rests of a wheelchair, and minimizing the required storage space therefor.

Further in accordance with the invention, the exercising device includes a base removably mountable on the foot rests of a wheelchair and which, preferably, is of sheet metal construction having a U-shaped configuration for slidably receiving the foot rests of a wheelchair. The closed end of the U engages the front edges of the foot rests to position the exercising device relative thereto and to the exerciser and, preferably, removable retaining elements extend through the base behind the foot rests to preclude unintentional separation of the exercising device from the foot rests. Each device includes an exercising arrangement mounted on the base and which facilitates the exercising of at least one of the arms and the legs of a person sitting in the wheelchair. Preferably, the exercising arrangement is adjustable relative to the base toward and away from the seat of the wheelchair so as to accommodate different physical statures of persons using the exercising device. As will be appreciated from the exercising devices described hereinafter, the exercising arrangement can provide for exercising the arms and/or legs of a person by requiring the latter to physically displace component parts of the exercising arrangement relative to the base, or can exercise the legs of a person by providing the motorized driving of component parts such as bicycle type pedals on which the user's feet rest.

It is accordingly an outstanding object of the present invention to provide exercising devices which are removably mountable on the foot rests of a wheelchair to facilitate exercising the arms and/or legs of a person sitting in the wheelchair.

Another object is the provision of exercising devices for use by a person sitting in a wheelchair and which, when in the use position relative to a wheelchair, enable movement of the latter along a floor or other underlying surface supporting the wheelchair.

Still another object is the provision of exercising devices of the foregoing character which are adjustable relative to the wheelchair to accommodate different physical statures of persons sitting in the chair and using the exercising devices.

Still another object is the provision of exercising devices of the foregoing character which are light in weight, structurally compact, economical to manufacture, and easy to manipulate with respect to the mounting and dismounting thereof relative to the foot rests of a wheelchair.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which:

FIG. 6 is a side elevation view of another embodiment of an exercising device in accordance with the invention;

DESCRIPTION OF PREFERRED EMBODIMENTS

Figure 1:
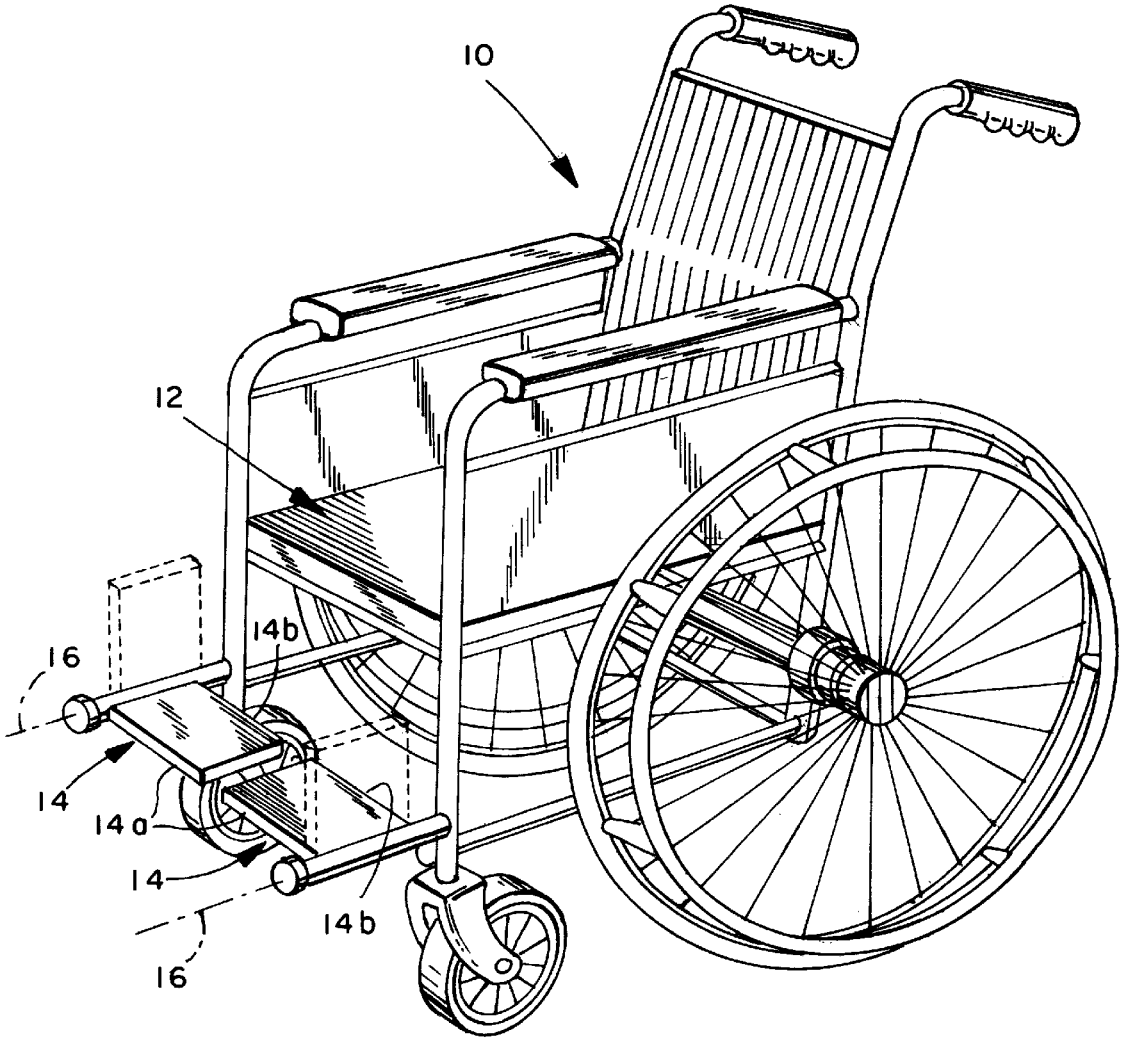
FIG. 1 is a perspective view of a wheelchair having foot rests for removably receiving an exercising device in accordance with the present invention.

Referring now in greater detail to the drawings, wherein the showings are for the purpose of illustrating preferred embodiments of the invention only and not for the purpose of limiting the invention, FIG. 1 illustrates a wheelchair 10 which includes a seat 12 for an occupant of the chair and a pair of foot rests 14 mounted on the chair frame forwardly of the seat. Each of the foot rests has an outer or front edge 14*a* and an inner or rear edge 14*b* and, as is well known, each of the foot rests 14 is mounted on the chair frame for pivotal displacement about a corresponding horizontal axis 16 between the horizontal, solid line positions and the vertical, broken line positions of the foot rests shown in FIG. 1. As is further well known, the foot rests are moved to the vertical position to enable a person to maneuver into the appropriate position to sit in seat 12, and when the person is seated the foot rests are displaced to the horizontal positions to support the persons feet above ground during movement of the wheelchair therealong. As will become apparent hereinafter, when a person is sitting in seat 12 and foot rests 14 are in the horizontal positions thereof, an exercising device is accordance with the invention is adapted to be mounted on the foot rests to facilitate exercising at least one of the arms and legs of the person.

Referring now to FIGS. 2–5 of the drawing, an exercising device in accordance with the present invention comprises a base 18 removably mountable on foot rests 14, and an exercising arrangement 20 mounted on base 18. Preferably, base 18 is of sheet metal construction, such as 1/16 inch sheet steel, and is U-shaped in cross-sectional contour providing a closed front end 22, upper and lower base plates 24 and 26, respectively, open rear end 28 and outwardly open laterally opposite sides 30 and 32. Upper and lower base plates 24 and 26 are spaced apart to slidably receive foot rests 14 therebetween and, preferably, the base is provided with a reinforcing member 34 centrally between the laterally opposite sides of the base and extending from rear end 28 to front end 22 thereof. Reinforcing member 34 can, for example, be a U-shaped sheet metal member having a closed end 36 adjacent rear end 28 of the base and legs 38 extending from closed end 36 to front end 22 of the base. Support member 34 is suitably secured in place between the upper and lower base plates, such as by welding.

Preferably, base 18 further includes a pair of removable retaining members extending through upper and lower base plates 24 and 26 adjacent rear end 28 of the base for releasably retaining the base on foot rest 14. In the embodiment illustrated in FIGS. 2–5, the retaining members are in the form of fasteners having threaded shanks 40 extending through openings provided therefor in the upper and lower base plates, a thumb plate 42 on one end for rotating the shank, and a spring clip-type nut 44 received on the rear edge of lower base plate 26 for threaded interengagement with shank 40. As will be appreciated from FIG. 2, closed front end 22 of base 18 is adapted to engage front edges 14*a* of foot rests 14 to position the base and thus exercising arrangement 20 relative to the wheelchair seat, and the retaining members are located behind rear edges 14*b* of the foot rests for engagement with the latter edges to preclude unintentional separation of the base and exercising arrangement from the foot rests. When it is desired to remove the exercising device from foot rest 14, the fasteners are removed so as to allow base 18 to slide forwardly and off of the foot rests.

In the embodiment illustrated in FIGS. 2–5, exercising arrangement 20 comprises a V-shaped support bracket 46 having front and rear legs 48 and 50, respectively, which extend upwardly from and respectively forwardly and rearwardly of base 18. Preferably, legs 48 and 50 are constructed of aluminum tubing and are suitably secured together at the apex of the V such as by welding. Bracket 46 is disposed between a pair of laterally spaced apart mounting plates 52 which extend upwardly from and are secured to upper base plate 24 such as by welding. Bracket 46 is pivotally supported on mounting plates 52 by a nut and bolt assembly 54 which extends through openings therefor in mounting plates 52 and the lower or inner end of leg 48. For the purpose set forth hereinafter, mounting plates 52 are provided with a plurality of laterally aligned apertures 56, and the laterally opposite sides of leg 48 of the mounting bracket are provided with openings, not designated numerically, which are adapted to be aligned with a pair of openings 56 to receive a nut and bolt assembly 58 for releasably holding support bracket 46 against pivoting about the axis provided by nut and bolt assembly 54.

Figure 3:
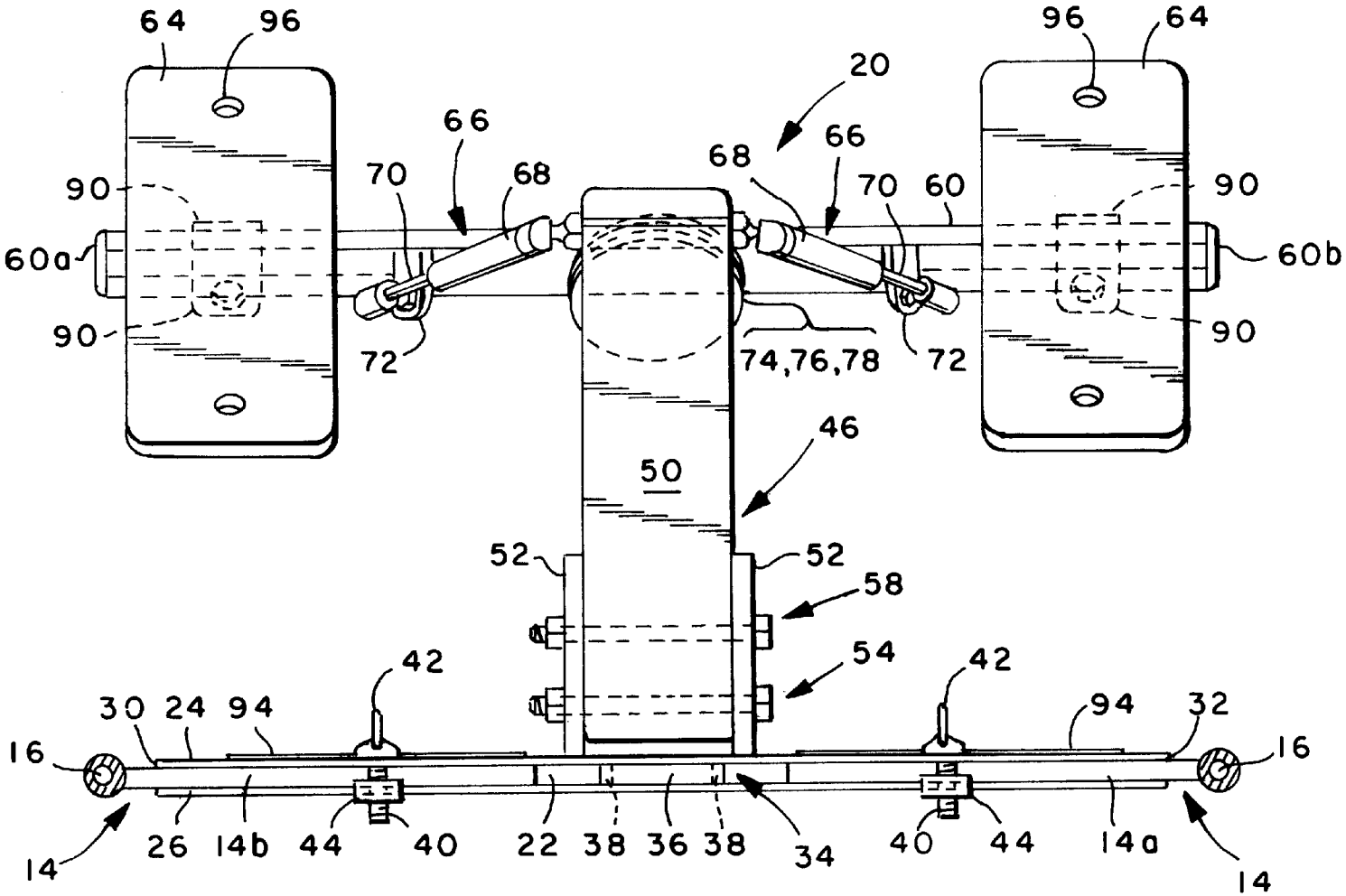
FIG. 3 is a rear elevation view of the device looking in the direction from the bottom of the page toward the top in FIG. 2.
Figure 4:
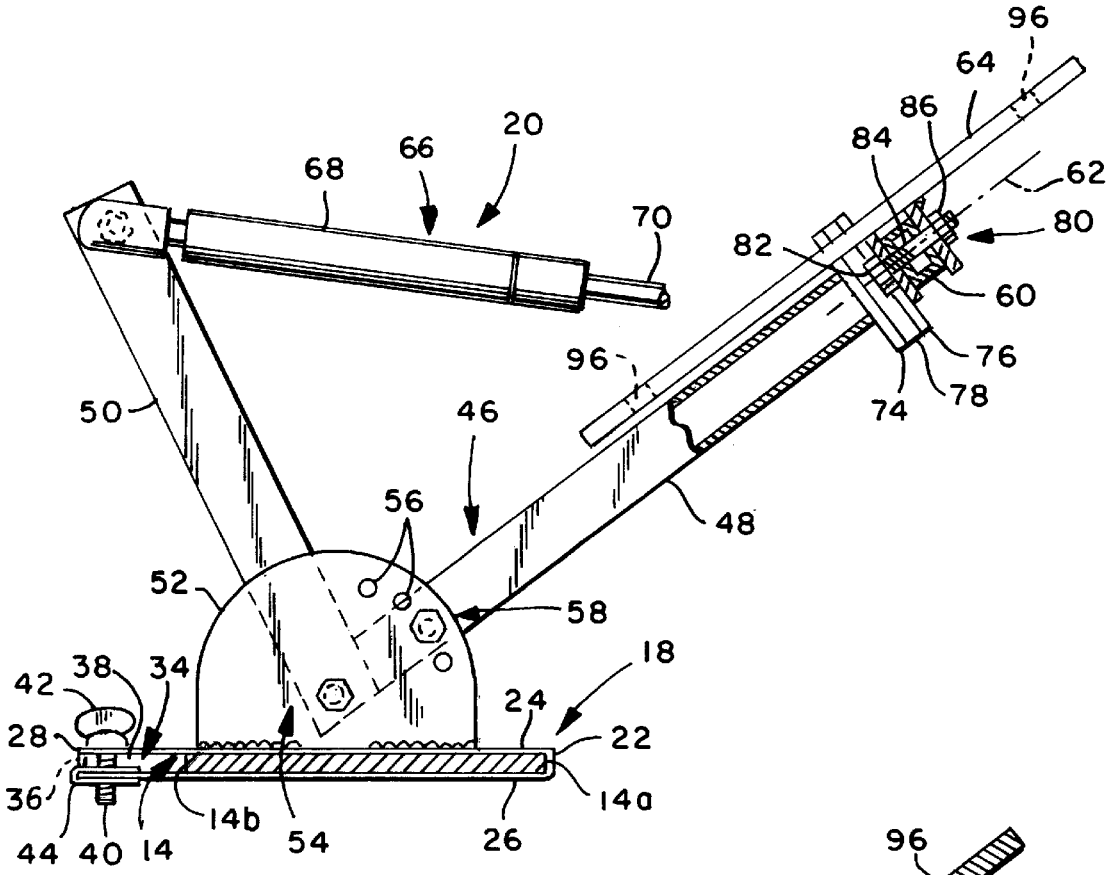
FIG. 4 is a sectional elevation view of the device taken along line 4—4 in FIG. 2.
Figure 5:
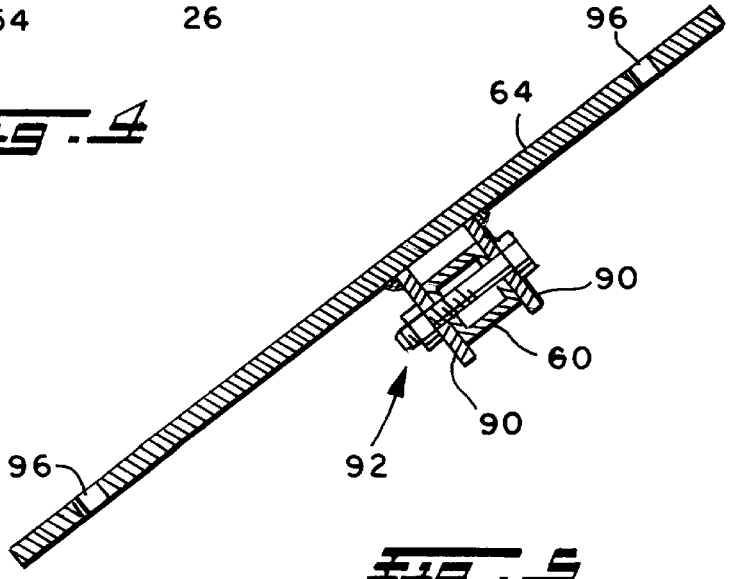
FIG. 5 is a sectional elevation view of a foot pad of the exercising device taken along line 5—5 in FIG. 2.
Figure 5:
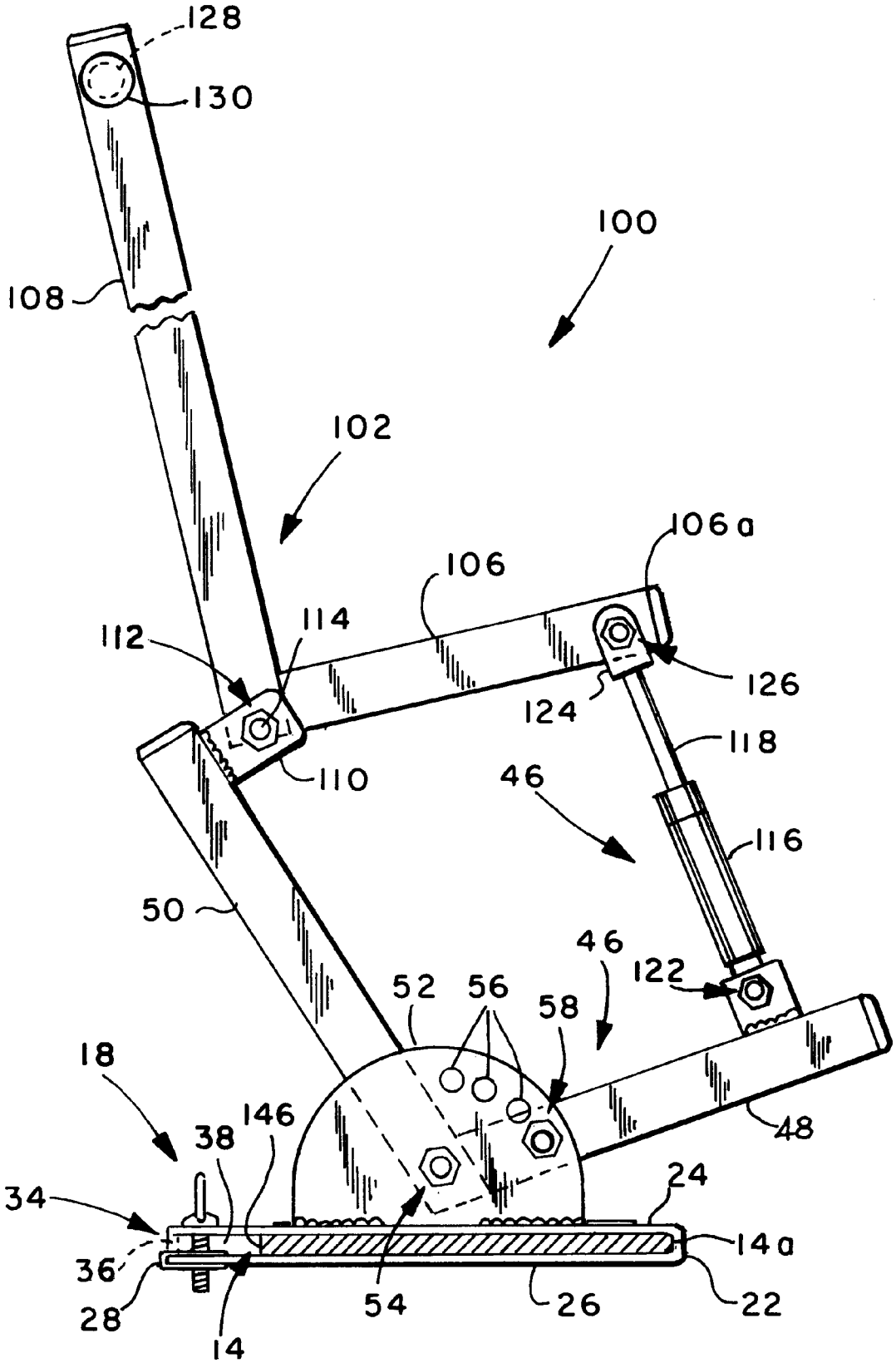

The exercising arrangement illustrated in FIGS. 3–5 is for exercising the legs of a person sitting in a wheelchair and, for this purpose, includes a laterally extending foot plate support member 60 mounted on the outer end of leg 48 for pivotal displacement in opposite directions about a foot plate pivot axis 62 which is coaxial with leg 48 and thus inclined at an angle to base 18 and lies in a vertical plane transverse to the front and rear ends of the base. Foot plate support member 60 has laterally outer ends 60*a* and 60*b* on laterally opposite sides of axis 62, and a foot plate 64 is mounted on member 60 adjacent each of the opposite ends thereof as set forth more fully hereinafter. Further, arrangements are provided for restraining or resisting pivotal displacement of foot plate support member 60 in opposite directions about axis 62 and, in the embodiment illustrated, such restraint is provided, in part, by a pair of spring devices 66 between support member 60 and the outer end of leg 50 of support bracket 46 and in part in connection with the mounting arrangement for support member 60 on the outer end of bracket leg 48. Further in this respect, spring devices 66 are preferably gas springs each comprising a cylinder component 68 having an outer end pivotally interconnected with a corresponding side of bracket leg 50 at the outer end thereof, and a piston rod 70 having an outer end pivotally connected to a mounting plate 72 inwardly adjacent the foot plate on the corresponding side of bracket leg 50. As is well known, piston rod 70 extends into cylinder 68 and is attached to a piston which is reciprocable within the cylinder, and the gas spring unit is charged with a suitable gas under pressure, such as nitrogen, which is operable on opposite sides of the piston through a valving arrangement to control relative displacement between the piston and cylinder in response to a load which extends or retracts the piston rod relative to the cylinder. Accordingly, it will be appreciated that when one of the foot pads 64 is depressed by the foot of a person sitting in the chair and using the exerciser, the gas spring units operate to restrain pivotal displacement of foot plate support member 60 in the direction corresponding to the direction of depression of the foot plate. When the other foot plate is then depressed to pivot the foot plate support member in the opposite direction about axis 62, the gas spring units again operate to restrain such pivotal displacement.

Figure 2:
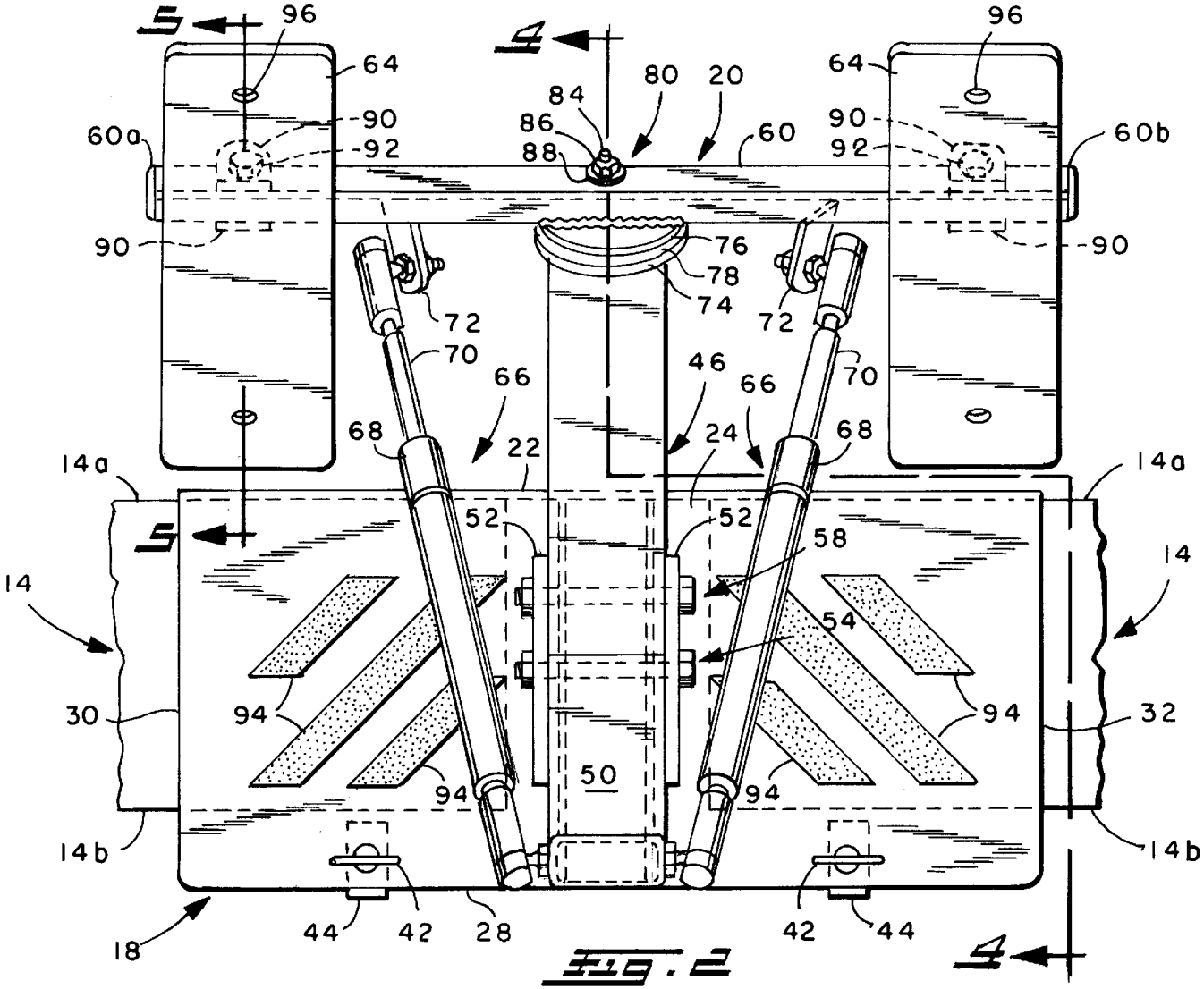
FIG. 2 is a plan view of one embodiment of an exercising device in accordance with the invention.

As mentioned above, further restraint against such pivotal displacement of the foot plate support member about axis 62 is provided in connection with the mounting of the foot plate support member on the outer end of bracket plate 48. In this respect, as best seen in FIGS. 2 and 4 of the drawing, the outer end of bracket leg 48 and the inner side of foot plate support member 60 are provided with annular metal plate members 74 and 76, respectively, secured to the corresponding one of leg 48 and support member 60 such as by welding, and an annular friction plate 78 of a suitable metal or plastic is axially interposed between plates 74 and 76. A nut and bolt assembly 80 provides pivot axis 62 for foot plate support member 60 and includes a head 82 secured to the inner side of plate 74 such as by welding, a threaded shank 84 extending through openings therefor in plates 74, 76 and 78 and through the inner and outer sides of foot plate support member 60, and a nut 86 which engages against a washer 88 between the nut and the outer side of member 60 to clampingly engage friction plate 78 between plates 74 and 76. Thus, by tightening or loosening nut 86 the friction between friction plate 78 and plates 74 and 76 is respectfully increased or decreased so as to increase or decrease the restraint against pivotal displacement of foot plate support member 60 in opposite directions about axis 62.

Foot plates 64 are preferably of metal and, as best seen in FIG. 5, the foot plates overlie the upper side of support member 60 and are pivotally interconnected therewith by a pair of mounting plates 90. Plates 90 are secured to the corresponding foot plate such as by welding and extend downwardly therefrom adjacent the outer and inner sides of support member 60, and a nut and bolt assembly 92 extends through openings therefor in mounting plates 90 and support member 60, not designated numerically, to provide the pivotal connection. The openings through mounting plates 90 are located therein so as to space foot plate 64 above the upper side of support member 60, whereby the foot plate is pivotal in opposite directions relative to support member 60 and about a pivot axis provided by nut and bolt assembly 92. Preferably, the upper surface of upper base plate 24 is provided with strips 94 of an abrasive or other anti-slip material, and foot plates 64 are provided with openings 96 therethrough to facilitate, if desired, the attachment of a special shoe, sandal, slipper or the like to the foot plate to receive the foot of a user of the exercise device.

It is believed that the mounting and use of the exercise device shown in FIGS. 2–5 will be obvious from the drawings and the preceding description thereof. Briefly in this respect, for example, and assuming that a person who is going to use the exercise device is sitting in the seat of wheelchair 10 with his or her feet on foot rests 14 in the horizontal positions thereof, the retaining elements adjacent rear end 28 of base 18 are removed and foot rests 14 are introduced into the rear end between upper and lower base plates 24 and 26 until front end 22 of the base engages against front edges 14*a* of the foot rests. During such mounting of the exercising device, the feet of the person sitting in the wheelchair can be slightly elevated to accommodate movement of base 18 onto the foot rests. The retaining members are then introduced to preclude the unintentional displacement of the base from the foot rests, and the persons feet are elevated to engage against the upper sides of foot plates 64. Then, as described above, the person alternately depresses foot plates 64 to pivot the foot plates and foot plate support member 60 in opposite directions about axis 62 against the resistance provided by gas spring units 66 and the friction plate unit between support member 60 and bracket leg 48. In connection with such pivotal displacement of foot plate support member 60 the pivotal interconnection of the foot plates therewith provided by nut and bolt assemblies 92 allows the foot plates to pivot relative to member 60 so as to preclude bending of the user's ankles. Accordingly, the user's legs are exercised, and the degree of exercise can be adjusted by adjusting the resistance of the friction plate unit. Furthermore, the positions of foot plates 64 relative to base 18 and the seat of the wheelchair can be adjusted to accommodate the physical stature of the person using the device and/or to adjust the degree of exercise. In this respect, the front and rear legs of support bracket 46 and thus the location of foot plates 64 can be adjusted by removing nut and bolt assembly 58 from mounting plates 52 and front bracket leg 48, pivoting bracket 46 to the location of another set of holes 56 in the mounting plates and reinserting the nut and bolt assembly 58 to releasably hold the exercising arrangement in the new position.

Figure 7:
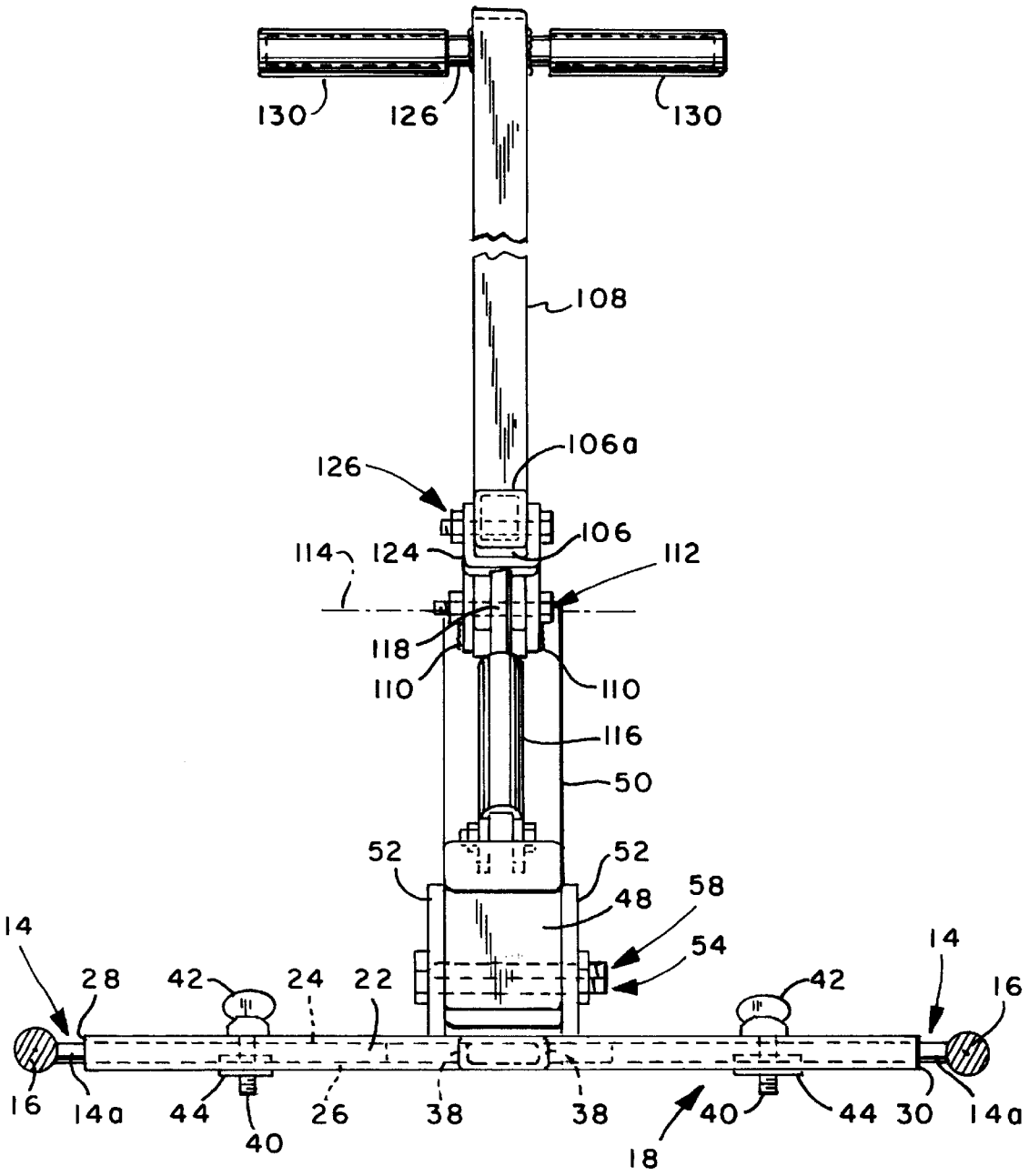
FIG. 7 is a front elevation view of the exercising device looking in the direction from right to left in FIG. 6.

FIGS. 6 and 7 illustrate another embodiment of an exercising arrangement, designated generally by the numeral 100, which includes a support bracket 46 and which is mounted on base 18 by mounting plates 52. Base 18, support bracket 46 and mounting plates 52 are substantially the same as described hereinabove in connection with the embodiment illustrated in FIGS. 2–5, whereby like numerals are used in FIGS. 6 and 7 to designate the corresponding parts in the two embodiments. In the embodiment of FIGS. 6 and 7, exercising arrangement 100 is for exercising the arms of a person sitting in the seat of a wheelchair and comprises an L-shape lever 102 and a restraining device 104 mounted on support bracket 46. More particularly in this respect, lever 102 comprises arms 106 and 108 and is mounted on the upper end of bracket leg 50 by mounting plates 110 extending forwardly thereof and receiving lever 102 therebetween, and a nut and bolt assembly 112 extending through the mounting plates and the lever at the juncture between arms 106 and 108. Nut and bolt assembly 112 provides a pivot axis 114 extending parallel to base 18 and in the direction between opposite sides 28 and 30 thereof, and arm 106 of lever 102 extends forwardly of pivot axis 114 and has an outer end 106*a* overlying the outer end of front leg 48 of support bracket 46. Restraining device 104 is a hydraulic piston and cylinder unit including a cylinder 116 which reciprocably supports a piston, not shown, and a piston rod 118 connected to the piston and extending outwardly from one end of a cylinder. The outer or lower end of cylinder 116 is pivotally attached to the outer end of bracket leg 48 by means of a pair of mounting plates 120 welded thereon and extending upwardly therefrom and a nut and bolt assembly 122 extending through the mounting plates and a mounting ear on the cylinder. The upper or outer end of piston rod 118 is provided with a U-shaped mounting bracket 124 which open upwardly to receive end 106*a* of lever arm 106, and a nut and bolt assembly 126 extends through the mounting bracket and lever arm to pivotally interconnect the end of the piston rod therewith. Restraining device 104 includes a hydraulic fluid in cylinder 116 which is ported between opposite sides of the piston to restrain displacement of the piston relative to the cylinder and, preferably, includes a biasing spring in cylinder 116, not shown, by which the piston and thus the piston rod is biased to an initial position as shown in FIG. 6. In the initial position the component parts of the exercising arrangement are positioned for operation of the exercising arrangement by a person sitting in the seat of a wheelchair on which the exercising device is mounted. More particularly in this respect, arm 108 of lever 102 extends upwardly from arm 106 and is provided on its upper or outer end with a tubular handle 128 which extends laterally outwardly of the opposite sides of arm 108. Preferably, handle 128 extends through an opening therefor in arm 108 and is secured thereto such as by welding, and the handle is provided with hand grips 130 of a suitable plastic or rubber material. It will be appreciated that lever arm 108 has a vertical length for positioning the handle at an appropriate level for a person sitting in the wheelchair and that, while not shown, the height of arm 108 could be adjustable such as by providing for the arm to be defined by telescopically interengaged members.

It is believed that the operation of exercising arrangement 100 will be obvious from the illustrations in FIGS. 6 and 7 and the foregoing description with respect thereto. Briefly, the exercising device is mounted on the foot rests of a wheelchair in the manner described hereinabove in connection with the embodiment shown in FIGS. 2–5, and the person sitting in the seat of the wheelchair rests his or her feet on upper base plate 24 which, while not shown, can be provided with a non-slip surface such as that provided by strips 94 in the embodiment of FIGS. 2–5. The person then grasps handle grips 130 and proceeds to exercise his or her arms by pulling arm 108 rearwardly, whereby lever 102 pivots counterclockwise about axis 114 against the restraint provided by the restraining device 104. When the person releases the pulling force on arm 108, the spring in cylinder 116 returns lever 102 to the initial position shown in FIG. 6. While the restraining device is described as a hydraulic piston and cylinder unit spring biased to the initial position, it will be appreciated that the device could be a gas spring of the character described in connection with the embodiment of FIGS. 2–5, or a hydraulic shock absorber type unit, whereby the person sitting in the wheelchair would exercise his or her arms by both pulling and pushing arm 108 to pivot lever 102 in opposite directions about axis 114 against the restraint provided in both directions by the restraining device. It will be further appreciated that the upper end of lever arm 108 could be provided with a coaxial hand grip portion as an alternative to or as a supplement to handle 128 and by which the person could exercise his or her arms individually by grasping and displacing arm 108 through such a coaxial handle portion.

Figure 8:
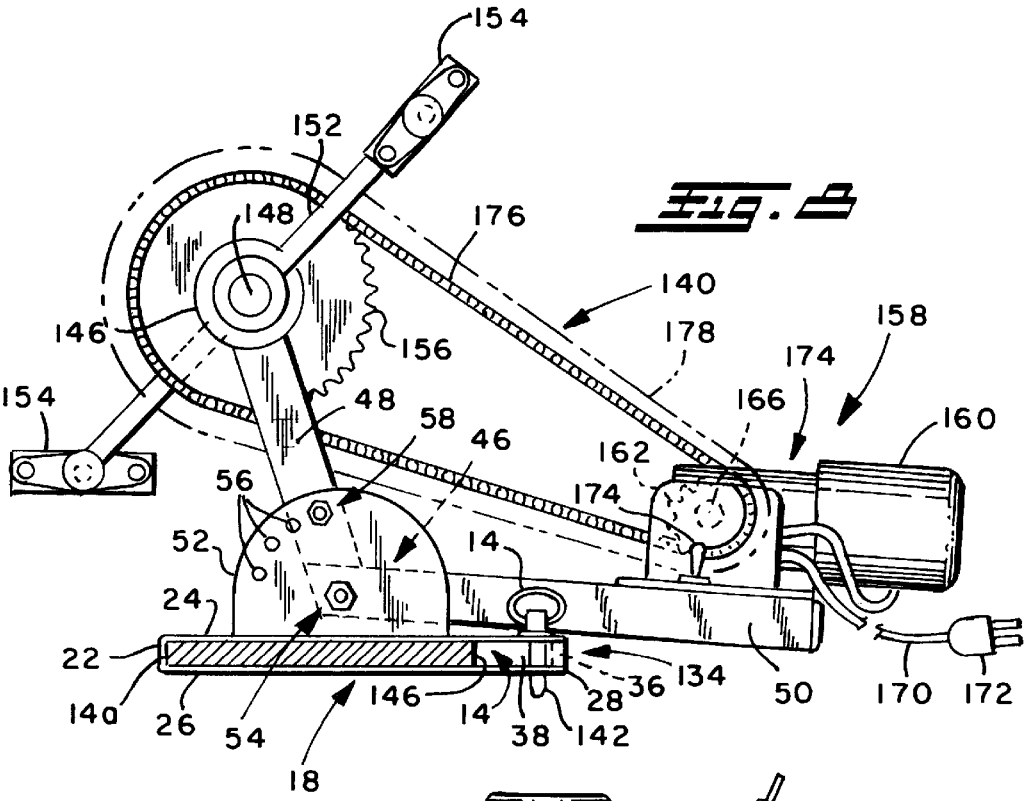
FIG. 8 is a side elevation view of still another embodiment of an exercising device in accordance with the invention; and, FIG. 9 is a plan view of the exercising device shown in FIG. 8.
Figure 9:
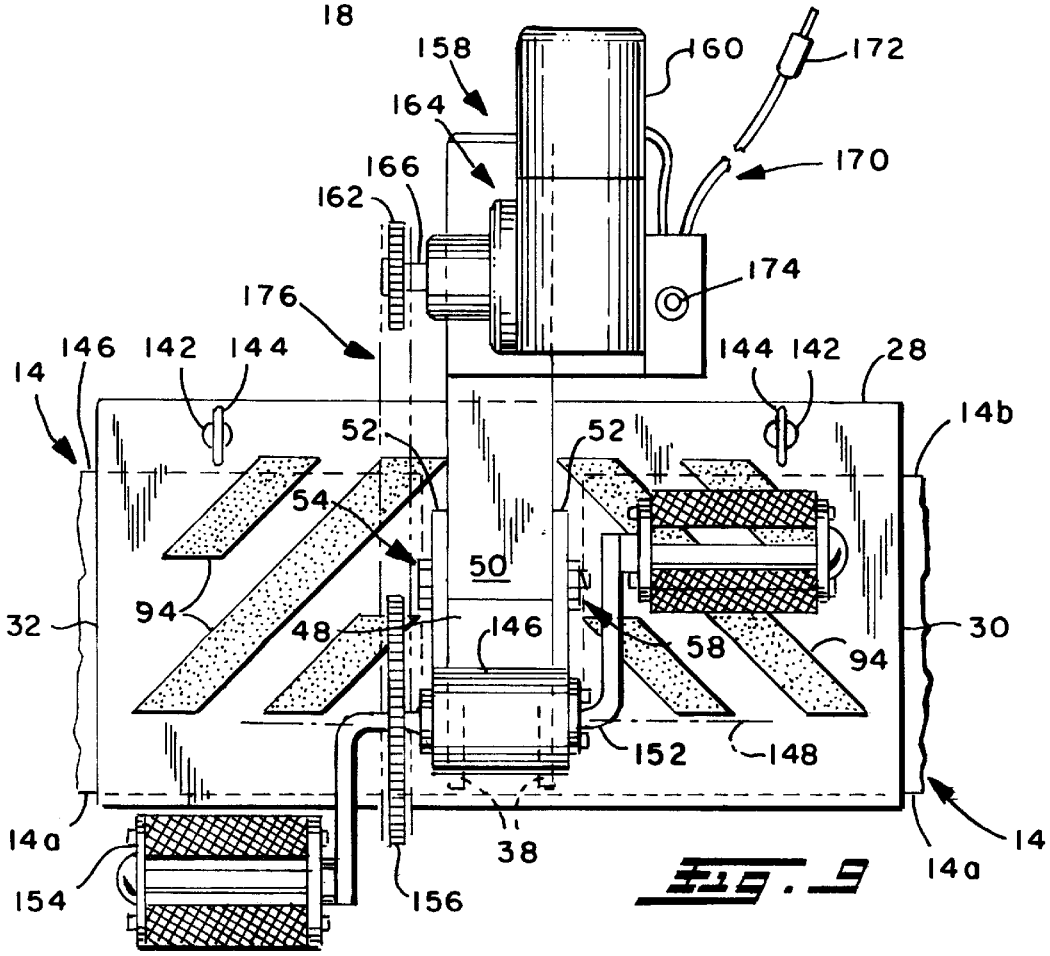

Another embodiment of an exercise device in accordance with the present invention is illustrated in FIGS. 8 and 9 of the drawing. In this embodiment, the exercising arrangement which is designated generally by the numeral 140 is for exercising the legs and ankles of a person sitting in a wheelchair. The exercise device includes a base 18, a support bracket 46 and mounting plates 52 for mounting exercising arrangement 140 on the base, and the base, support bracket and mounting plates are substantially the same as described hereinabove in connection with the embodiments illustrated in FIGS. 2–5 and FIGS. 6 and 7. Accordingly, like numerals appear in FIGS. 8 and 9 for designating component parts corresponding to those in the earlier embodiments. One difference with respect to base 18 is that the retaining members for limiting displacement of the base forwardly of the wheelchair foot rests are provided by a pair of pins 142 extending downwardly through openings therefor in upper and lower base plates 24 and 26, and a ring member 144 extending through the upper end of each pin. Each ring 144 engages upper base plate 24 to limit downward displacement of the corresponding pin 142 and provides a pull by which the pin can be removed from the base. With respect to support bracket 46, the front and rear legs 48 and 50 of thereof are at a somewhat greater angle relative to one another then in the previous embodiments, and rear leg 50 is longer relative to the pivot axis provided by nut and bolt assembly 54 then in the previous embodiments. However, the function of support bracket 46 in connection with supporting the component parts of exercising arrangement 140 and providing for adjusting the position thereof relative to a person using the exercise device is the same as in the previous embodiments.

Exercising arrangement 140 includes a bearing housing 146 mounted on the upper or outer end of front leg 48 of support bracket 46 and having an axis 148, and a foot pedal lever and sprocket wheel assembly 150 supported by bearings in housing 146 for rotation about axis 148. Foot pedal lever and sprocket wheel assembly 150 includes a foot pedal lever 152 having diametrically spaced apart opposite ends on axially opposite sides of housing 146, foot pedals 154 rotatably mounted on the ends of lever 152, and a sprocket wheel 156 fixed on the pedal lever for rotation therewith. In the embodiment illustrated, exercising arrangement 140 further includes a drive unit 158 for rotating sprocket wheel 156 and thus foot pedal lever 152 about axis 148. Drive unit 158 is mounted on the outer end of rear leg 50 of support bracket 46 and comprises an electric motor 160 for rotating a drive sprocket wheel 162 through a speed reducing unit 164 having an output shaft 166 on which sprocket wheel 162 is mounted for rotation therewith about a drive sprocket axis 168 which is parallel to axis 148 of the foot pedal lever and sprocket wheel assembly 150. Motor 160 is adapted to be connected to a suitable source of electrical power through a cord 170 having a plug 172 on the free end thereof, and an on-off switch 174 is interposed in cord 170 between motor 160 and plug 172 for controlling the operation of the motor and thus the exercising arrangement. Sprocket wheels 156 and 162 are drivingly interengaged by a sprocket chain 176 trained thereabout and, preferably, the sprocket chain and sprocket wheels are enclosed in a protective cover or chain guard 178 as schematically illustrated in FIG. 8.

In operation, the exercise device is mounted on the foot rests of a wheelchair in the manner described hereinabove, the feet of the person sitting in the chair are moved into (engagement with foot pedals 154, and switch 174 is actuated to energize motor 160, whereupon drive sprocket wheel 166 rotates at a slow speed to rotate sprocket wheel 156 at a slow speed through sprocket chain 176. In response to rotation of sprocket wheel 156, foot pedal lever 152 rotates to flex the knees and ankles of the person sitting in the wheel chair. Operation of the exercising arrangement in this manner advantageously provides the necessary motion and movement in the knees and ankles of a person who is unable to physically pedal a bicycle-type exercising machine such as, for example, a person who just undergone knee surgery. At the same time, it will be appreciated that the exercising arrangement can be modified for the motor and speed reducing assembly to operate, without energizing motor 160, to restrain rotation of sprocket wheel 156 in response to a person physically displacing foot pedal lever 152 about axis 148, thereby promoting versatility with respect to the exercising capabilities of the device. Alternatively, an arrangement for restraining rotation of foot pedal lever 152 could be incorporated in bearing housing 146.

As mentioned herein, an exercising device in accordance with the invention is structurally compact and light in weight which facilitates the storage thereof and the handling thereof in connection with the mounting and removal of the device from its use position in association with the wheelchair. More particularly with regard to these attributes, in the embodiments of the invention disclosed herein the base of each of the exercise devices is 15 inches wide and 7½ inches long and is constructed from 1/16 inch sheet steel for the upper and lower base plates to be spaced apart ½ inch. The bracket mounting plates on the upper base plate are ⅛ inch thick sheet steel, and the V-shaped support brackets are constructed from one inch by two inch aluminum tubing.

The lever of the arm exerciser in FIGS. 6 and 7 and the foot plate support member on the exercise device shown in FIGS. 2–5 are constructed from one inch square aluminum tubing, and the foot plates on the latter exercise device are constructed of ⅛ inch sheet steel. The bicycle type exerciser is about 18 inches long.

While considerable emphasis has been placed herein on the structures and structural interrelationships between the component parts of preferred embodiments of an exercising device in accordance with the invention, it will be appreciated that other embodiments can be devised and that the embodiments herein illustrated and described can be modified without departing from the principles of the invention. In particular in this respect, exercising arrangements other than those herein disclose can be mounted on the base of the exercise device, and such other arrangements as well as those herein illustrated and described can be mounted permanently on the base as opposed to through an adjustable mounting arrangement. Further, adjustable mounting arrangements other than herein disclosed can be readily devised as can other restraining arrangements and adjustable restraints for varying the force requirements in connection with displacing the component parts of the exercising arrangements by a person using the same. Still further, it will be appreciated that plural exercising arrangements can be provided in conjunction with a single exercising device. In this respect, for example, lever 102 shown in FIG. 6 can be attached to the front and rear legs of support bracket 46 of exercising arrangement 20 shown in the embodiment of FIGS. 2–5, whereby the exercise device would include both leg and arm exercising arrangements. These and other modifications of the preferred embodiments as well as other embodiments of the invention will be obvious and suggested to those skilled in the art from the disclosure herein, whereby the foregoing descriptive matter is to be interpreted merely as illustrative of the invention and not as a limitation.

Having thus described the invention, it is so claimed:

1. An exercise device for attachment to a wheelchair having a seat and horizontal foot rests forwardly of the seat for supporting the feet of a person sitting in the seat, the exercise device comprising a base removably mountable on the horizontal foot rests of a wheelchair, exercising means for exercising at least one of the legs and arms of a person sitting in the seat of the wheelchair, and means for mounting said exercising means on said base, said base including upper and lower base plates fixedly spaced apart to receive the horizontal foot rests of a wheelchair therebetween.

2. An exercise device according to claim 1, wherein said exercising means includes a support bracket the means for mounting includes means supporting said bracket for adjustment relative to said base to adjust the position of said exercising means forwardly and rearwardly of said seat.

3. An exercise device according to claim 1, wherein said means for mounting includes means for adjusting the position of said exercising means on said base forwardly and rearwardly of the seat.

4. An exercise device according to claim 1, and means for releasably retaining said base on the foot rests.

5. An exercise device according to claim 1, wherein said base has front and rear ends and means interconnecting said upper and lower plates at said front end for engaging foot rests to position said base in the direction toward seat.

6. An exercise device according to claim 1, wherein said exercising means comprises a pair of foot plates spaced above said base and supported for displacement toward arid away from said base, and means for restraining displacement of said foot plates relative to said base.

7. An exercise device according to claim 6, wherein said base has front and rear ends and laterally opposite sides, said foot plates being laterally spaced apart and supported for pivotal displacement in opposite directions about an axis therebetween.

8. An exercise device according to claim 7, wherein said foot plates have a neutral position in which the foot plates are equally spaced above said base, and said means for mounting including means for selectively adjusting the space between said foot plates and said base in said neutral position.

9. An exercise device according to claim 1, wherein said exercising means comprises a lever extending upwardly of said base and being pivotal relative thereto toward and away from the seat, said lever having an upper end for displacing said lever relative to said base, and means for restraining displacement of said lever relative to said base.

10. An exercise device according to claim 9, wherein said lever has an initial position relative to the seat and said means for restraining displacement includes biasing means for biasing said lever toward said initial position.

11. An exercise device according to claim 10, wherein said lever in said initial position extends upwardly at an angle relative to said base, and said means for mounting including means for selectively adjusting the angle of said lever relative to said base in said initial position of said lever.

12. An exercise device according to claim 10, wherein said means for restraining displacement includes relatively displaceable piston and cylinder means having an initial position corresponding to said initial position of said lever, said biasing means biasing said piston and cylinder means toward said initial position thereof.

13. An exercise device according to claim 12, wherein said lever in said initial position thereof extends upwardly at an angle relative to said base, and said means for mounting including means for selectively adjusting the angle of said lever relative to said base in said initial position of said lever.

14. An exercise device according to claim 1, wherein said exercising means comprises a pair of foot pedals on a foot pedal lever mounted on said base for rotation about a pedal lever axis spaced above and parallel to said base, said pedals being axially spaced apart and on diametrically opposite sides of said axis.

15. An exercise device according to claim 14, and means including a motor for rotating said pedal lever about said axis.

16. An exercise device according to claim 15, wherein said means for rotating said pedal lever includes a first sprocket wheel on said pedal lever for rotation therewith about said pedal lever axis, a second sprocket wheel rotatable about a sprocket wheel axis parallel to and laterally spaced from said pedal lever axis, means interconnecting said motor with said second sprocket wheel for rotating said second sprocket wheel, and a sprocket chain drivingly interconnecting said first and second sprocket wheels.

17. An exercise device according to claim 16, wherein said means interconnecting said motor with said second sprocket wheel includes speed reducing means.

18. An exercise device according to claim 16, wherein said means for mounting includes means for selectively adjusting the spacing of said pedal lever axis above said base.

19. An exercise device according to claim 14, wherein said means for mounting includes means for selectively adjusting the spacing of said pedal lever axis above said base.

20. An exercise device for attachment to a wheelchair having a seat and foot rests forwardly of the seat for supporting the feet of a person sitting in the seat, the exercise device comprising a base removably mountable on the foot rests of a wheelchair, exercising means for exercising at least one of the legs and arms of a person sitting in the seat of the wheelchair, means for mounting said exercising means on said base, said exercising means including a support bracket and said means for mounting including means supporting said bracket for adjustment relative to said base to adjust the position of said exercising means forwardly and rearwardly of the seat, said base having front and rear ends and laterally opposite sides between said ends, said bracket being V-shaped and having front and rear legs respectively extending forwardly and rearwardly of said base, and means pivotally interconnecting said bracket with said base for said front and rear legs to pivot about an axis extending in the direction between said sides.

21. An exercise device according to claim 20, wherein said means pivotally interconnecting said bracket with said base includes means for releasably supporting said bracket in any one of a plurality of positions about said axis.

22. An exercise device for attachment to a wheelchair having a seat and foot rests forwardly of the seat for supporting the feet of a person sitting in the seat, the exercise device comprising a base removably mountable on the foot rests of a wheelchair, exercising means for exercising at least one of the legs and arms of a person sitting in the seat of the wheelchair, and means for mounting said exercising means on said base, said base including upper and lower base plates spaced apart to receive the foot rests of a wheelchair therebetween, said base having front and rear ends and means interconnecting said upper and lower plates at said front end for engaging the foot rests to position said base in the direction toward the seat, and removable retaining means between said upper and lower plates adjacent said rear end of said base for engaging the foot rests to limit movement of said base in the direction away from the seat.

23. An exercise device for attachment to a wheelchair having a seat and foot rests forwardly of the seat for supporting the feet of a person sitting in the seat, the exercise device comprising a base removably mountable on the foot rests of a wheelchair, exercising means for exercising at least one of the legs and arms of a person sitting in the seat of the wheelchair, and means for mounting said exercising means on said base, said base having front and rear ends and laterally opposite sides between said ends, said exercising means including a V-shaped support bracket on said base having front and rear legs respectively extending forwardly and rearwardly of said base, and said mounting means including means interconnecting said bracket with said base for releasably supporting said bracket in any one of a plurality of positions on said base for selectively adjusting the position of said exercising means on said base forwardly and rearwardly of the seat.

24. An exercise device according to claim 23, wherein said means interconnecting said bracket with said base includes means pivotally mounting said bracket on said base for said front and rear legs to pivot about an axis extending in the direction between said sides.

25. An exercise device according to claim 24, wherein said base includes upper and lower base plates spaced apart to receive the foot rests of a wheelchair therebetween, said base having front and rear ends, and means interconnecting said upper and lower plates at said front end for engaging the foot rests to position said base in the direction toward the seat.

26. An exercise device according to claim 25, and retaining means between said upper and lower plates adjacent said rear end of said base for engaging the foot rests to limit movement of said base in the direction away from the seat.

27. An exercise device for attachment to a wheelchair having a seat and foot rests forwardly of the seat for supporting the feet of a person sitting in the seat, the exercise device comprising a base removably mountable on the foot rests of a wheelchair, exercising means for exercising at least one of the legs and arms of a person sitting in the seat of the wheelchair, and means for mounting said exercising means on said base, said exercising means comprising a pair of foot plates spaced above said base and supported for displacement toward and away from said base, means for restraining displacement of said foot plates relative to said base, said base having front and rear ends and laterally opposite sides, said foot plates being laterally spaced apart and supported for pivotal displacement in opposite directions about an axis therebetween, and said axis being inclined downwardly and rearwardly relative to said front and rear ends of said base.

28. An exercise device according to claim 27, wherein said foot plates have a neutral position in which the foot plates are equally spaced above said base, and said means for mounting includes means for selectively adjusting the space between said foot plates and said base in said neutral position.

29. An exercise device according to claim 28, wherein said means for restraining displacement comprises gas spring means.

30. An exercise device for attachment to a wheelchair having a seat and foot rests forwardly of the seat for supporting the feet of a person sitting in the seat, the exercise device comprising a base removably mountable on the foot rests of a wheelchair, said base having front and rear ends and laterally opposite sides, a V-shaped support bracket on said base having front and rear legs respectively extending forwardly and rearwardly of said base, said front leg having an outer end, a foot plate support member mounted on said outer end for pivotal displacement in opposite directions about a foot plate pivot axis in a plane transverse to said front and rear ends, said support member having lateral outer ends on opposite sides of said pivot axis, a foot plate on each of said outer ends of said support member, and means for restraining pivotal displacement of said support member about said pivot axis.

31. An exercise device according to claim 30, further including means interconnecting said bracket with said base for said front and rear legs to pivot about a bracket axis extending in the direction between said sides, and means for releasably supporting said bracket in any one of a plurality of positions about said bracket axis.

32. An exercise device according to claim 30, wherein said means for restraining pivotal displacement of said foot plate support member about said pivot axis includes friction plate means between said support member and said outer end of said front leg.

33. An exercise device according to claim 30, wherein said means for restraining pivotal displacement of said foot plate support member about said pivot axis includes a pair of spring means each extending between said rear leg and a location on said support member between said pivot axis and a different one of the foot plates thereon.

34. An exercise device according to claim 33, wherein said means for restraining pivotal displacement of said foot plate support member about said pivot axis further includes friction plate means between said support member and said outer end of said front leg.

35. An exercise device according to claim 34, further including means interconnecting said bracket with said base for said front and rear legs to pivot about a bracket axis extending in the direction between said sides, and means for releasably supporting said bracket in any one of a plurality of positions about said bracket axis.

36. An exercise device according to claim 35, wherein said base includes upper and lower base plates spaced apart to receive the foot rests of a wheelchair therebetween.

37. An exercise device according to claim 36, wherein said friction plate means is adjustable for adjusting the restraint against pivotal displacement of said foot support member.

38. An exercise device according to claim 37, wherein said spring means are gas springs.

39. An exercise device according to claim 30, wherein said base includes upper and lower base plates spaced apart to receive the foot rests of a wheelchair therebetween.

40. An exercise device for attachment to a wheelchair having a seat and horizontal foot rests forwardly of the seat for supporting the feet of a person sitting in the seat, the exercise device comprising a base removably mountable on the horizontal foot rests of a wheelchair, said base including upper and lower base plates fixedly spaced apart to receive the horizontal foot rests of a wheelchair therebetween, said base having front and rear ends and laterally opposite sides, and exercising means comprising a V-shaped support bracket mounted on said base and having front and rear legs respectively extending forwardly and rearwardly of said base, each said front and rear leg having an outer end, an L-shaped lever mounted on said outer end of said rear leg for pivotal displacement toward and away from the seat about a lever axis extending in the direction between said sides of said base, said lever including a first arm extending from said lever axis toward said front end of said base and a second arm extending upwardly from said first arm and having an upper end for pivoting said lever about said lever axis, and restraining means between said first arm of said lever and said front leg of said bracket for restraining pivotal movement of said lever from an initial position.

41. An exercise device according to claim 40, wherein said lever has an initial position relative to the seat and said restraining means includes biasing means for biasing said lever to said initial position.

42. An exercise device according to claim 40, further including means interconnecting said bracket with said base for said front and rear legs to pivot about a bracket axis extending in the direction between said sides, and means for releasably supporting said bracket in any one of a plurality of positions about said bracket axis.

43. An exercise device according to claim 40, wherein said restraining means includes relatively displaceable piston and cylinder means.

44. An exercise device according to claim 43, wherein said lever has an initial position relative to the seat and said restraining means includes biasing means for biasing said lever to said initial position.

45. An exercise device according to claim 44, wherein said piston and cylinder means has an initial position therebetween corresponding to said initial position of said lever, and said biasing means includes spring means biasing said piston and cylinder means toward said initial position thereof.

46. An exercise device according to claim 45, further including means interconnecting said bracket with said base for said front and rear legs to pivot about a bracket axis extending in the direction between said sides, and means for releasably supporting said bracket in any one of a plurality of positions about said bracket axis.

47. An exercise device for attachment to a wheelchair having a seat and horizontal foot rests forwardly of the seat for supporting the feet of a person sitting in the seat, the exercise device comprising a base removably mountable on the horizontal foot rests of a wheelchair, said base including upper and lower base plates fixedly spaced apart to receive the horizontal foot rests of a wheelchair therebetween, said base having front and rear ends and laterally opposite sides, and exercising means comprising a V-shaped support bracket mounted on said base and having front and rear legs respectively extending forwardly and rearwardly of said base, each said front and rear leg having an outer end, a bearing housing on said cuter end of said front leg having a first axis extending in the direction between said sides of said base, a foot pedal lever supported in said bearing housing for rotation about said first axis, a first sprocket wheel on said foot pedal lever for rotation therewith, diametrically spaced apart foot pedals on said foot pedal lever on axially opposite sides of said first sprocket wheel, drive motor and sprocket wheel means on said outer end of said rear leg comprising a second sprocket wheel and drive motor and speed reducing means for rotating said second sprocket wheel about a second axis parallel to said first axis, and a sprocket chain trained about said first and second sprocket wheels for rotating said foot pedals about said first axis in response to operation of said drive motor.

48. An exercise device according to claim 47, further including means interconnecting said bracket with said base for said front and rear legs to pivot about a bracket axis extending in the direction between said sides, and means for releasably supporting said bracket in any one of a plurality of positions about said bracket axis.

49. An exercise device according to claim 47, further including means interconnecting said bracket with said base for said front and rear legs to pivot about a bracket axis extending in the direction between said sides, and means for releasably supporting said bracket in any one of a plurality of positions about said bracket axis.

* * * * *